US009834349B1

(12) United States Patent
Gallagher

(10) Patent No.: US 9,834,349 B1
(45) Date of Patent: Dec. 5, 2017

(54) BOTTLE CARRIER

(71) Applicant: Kenneth John Gallagher, Las Vegas, NV (US)

(72) Inventor: Kenneth John Gallagher, Las Vegas, NV (US)

( * ) Notice: Subject to any disclaimer, the term of this patent is extended or adjusted under 35 U.S.C. 154(b) by 0 days.

(21) Appl. No.: 15/458,686

(22) Filed: Mar. 14, 2017

Related U.S. Application Data

(63) Continuation-in-part of application No. 15/424,829, filed on Feb. 4, 2017.

(51) Int. Cl.
*B65D 39/00* (2006.01)
*B65D 51/24* (2006.01)
*B65D 23/10* (2006.01)
*B65D 41/04* (2006.01)

(52) U.S. Cl.
CPC ..... *B65D 51/242* (2013.01); *B65D 23/108* (2013.01); *B65D 41/04* (2013.01); *B65D 51/243* (2013.01)

(58) Field of Classification Search
CPC ..... B65D 51/24–51/243; B65D 41/02–41/04; B65D 23/10–23/108
USPC ..... 215/226, 316, 329, 396, 228; 220/212.5, 220/318, 710.5, 752, 288, 289, 315, 327, 220/328
See application file for complete search history.

(56) References Cited

U.S. PATENT DOCUMENTS 3,275,366 A 9/1966 Hidding
3,463,536 A 8/1969 Updegraff
4,747,501 A * 5/1988 Greaves ..... B65D 51/223 215/226
4,768,403 A 9/1988 Bar-Noy
4,846,360 A * 7/1989 Criste ..... B65D 51/243 215/226
5,090,582 A * 2/1992 Art ..... B65D 51/225 215/226
5,183,169 A 2/1993 Grzych
5,409,151 A 4/1995 Freimark
5,499,473 A * 3/1996 Ramberg ..... A01K 97/05 220/532
5,564,583 A * 10/1996 Kelley ..... A45C 11/20 220/23.83
5,577,647 A 11/1996 Pitarelli
5,810,218 A 9/1998 Falcaro
6,019,241 A * 2/2000 Burns ..... B44D 3/126 15/257.06
6,394,517 B1 5/2002 Borg
7,377,071 B1 * 5/2008 Thompson ..... A01K 97/05 43/56
8,443,993 B1 * 5/2013 Desselle ..... B65D 55/16 215/235
2009/0122259 A1 * 5/2009 Szumski ..... A45C 11/04 351/158

(Continued)

*Primary Examiner* — Kareen Thomas

(57) ABSTRACT

A bottle carrier for use with a bottle is disclosed. The bottle has a screw cap. The bottle carrier has a diameter of at least two inches. An internally threaded socket has a solid ceiling and a perimeter. The internally threaded socket receives an externally threaded bottle top of the bottle. The bottle carrier replaces the screw cap. At least two apertures in the bottle carrier receive a handle. The apertures extend through the bottle carrier beyond the perimeter of the internally threaded socket. A handle engages the bottle carrier through at least two apertures of the bottle carrier.

11 Claims, 14 Drawing Sheets

(56) References Cited

U.S. PATENT DOCUMENTS

| | | | |
|---|---|---|---|
| 2013/0098958 | A1 | 4/2013 | Caccialino |
| 2015/0041427 | A1 | 2/2015 | Taw |

* cited by examiner

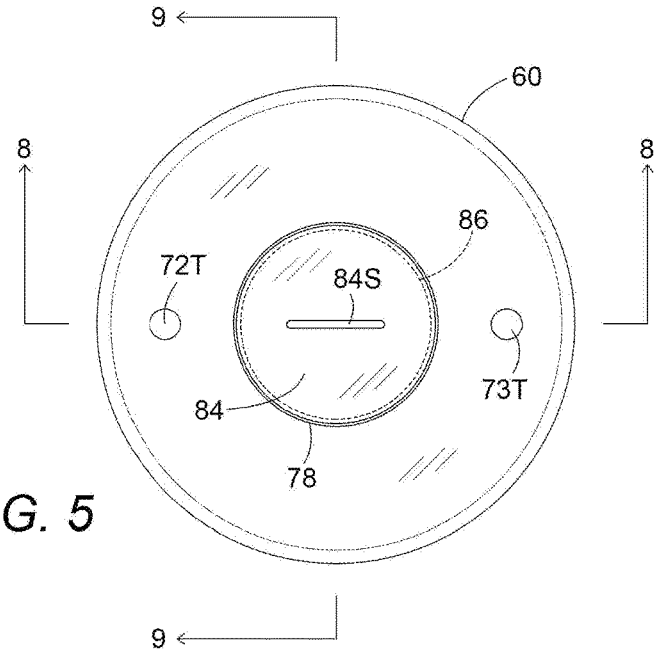
FIG. 5
FIG. 6
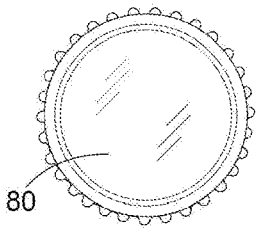
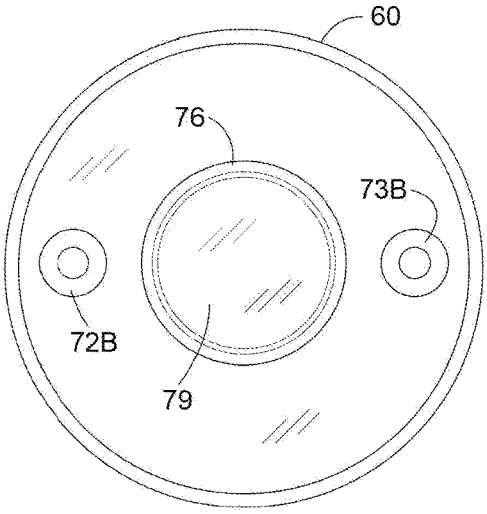
FIG. 7

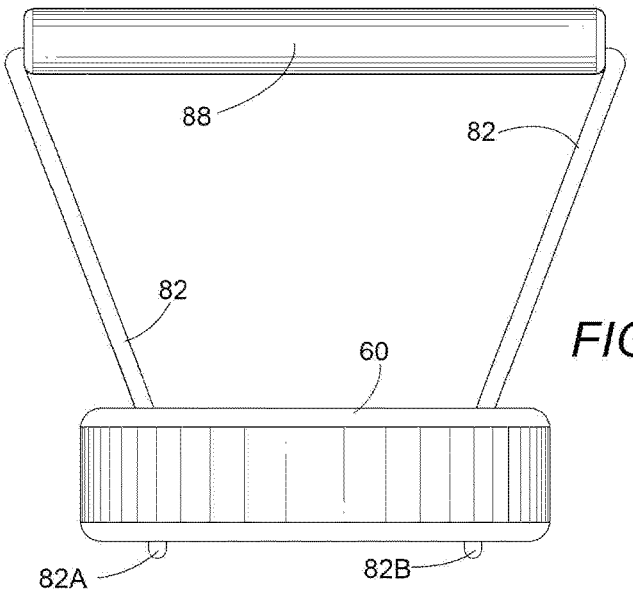
FIG. 12
FIG. 13
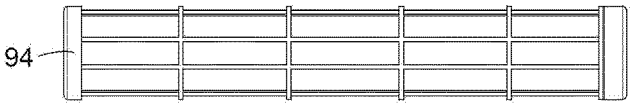
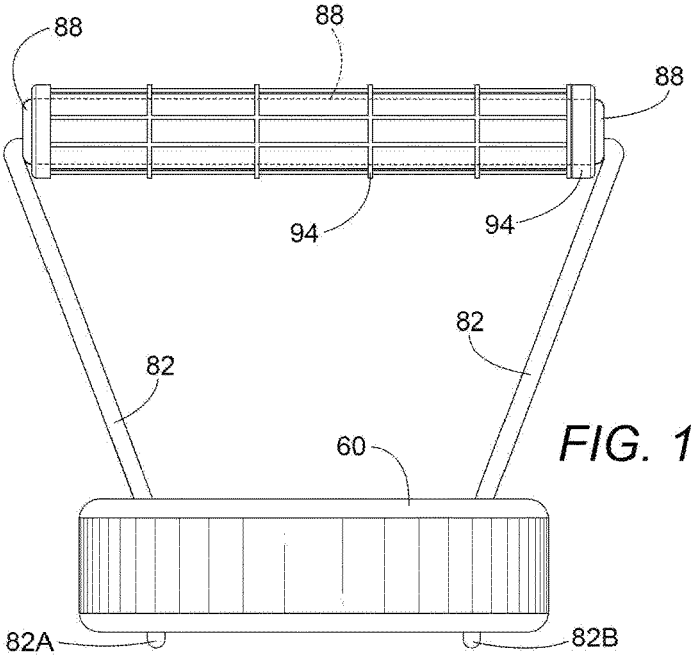
FIG. 14

BOTTLE CARRIER

CROSS REFERENCE TO RELATED APPLICATIONS

This is a continuation-in-part of application Ser. No. 15/424,829 filed on 2017 Feb. 4, entitled "BOTTLE CAP DEVICE" in the name of Kenneth J. Gallagher, and which is incorporated herein by reference in its entirety.

BACKGROUND OF THE DISCLOSURE

The present application relates to screw caps that are widely used in the beverage and water bottle industry, and bottle carriers that provide a convenient method for the transportation of beverage and water bottles.

The bottled beverage and bottled water industry is thriving in the United States and abroad. Currently most of the bottles in the industry are made of PET (Polyethylene Terephthalate) plastic. The majority of the PET bottles in the industry range in size from 4 oz. to 1 gallon. With water weighing in at 8.36 pounds per gallon, the larger PET bottles in the industry can prove to be very burdensome to carry for anyone, and especially the elderly. Nevertheless, most of the large PET beverage and water bottles in the industry are without handles. Of the bottles that do have handles, the industry has built many of them into the actual structure of the bottle. However, many of the plastic handles developed may be quite uncomfortable or even injurious to the human hand as they may embody small diameters, and require that the bottle be held at awkward angles. More recently, plastic handles are now being attached to the neck of the bottles. Unfortunately, these cheap disposable handles are made from thin plastic and may be extremely hard on the human hand when carrying the heavier three liter to one gallon bottles around the house, to the park, to the gym, or to a sporting event. Consequently, there is a need for a handle for all the large beverage and water bottles that have no handle, and a need for an improved handle in the industry for the bottles that do have handles, a handle that may not be so hard on, or injurious to the human hand.

In addition to having handle problems, these PET beverage and water bottles serve up another problem as well. Many of the screw caps attached to these beverage and water bottles may be extremely difficult to remove from the bottles especially upon first removal from their factory positioning. If the human hand is wet, the difficulty of removing the screw cap from the bottle is compounded further. For the elderly, removal of a screw cap may prove extremely difficult. An Injury, or an abrasion to the hand may occur in the process of removing some of the more tightly connected screw caps. Accordingly, screw cap removal tools have been developed to facilitate the removal of screw caps from these bottles as to avoid any injury or abrasions to the human hand. Also, a large number of the beverage and water bottle screws caps on the market today have diameters of less than one inch, thus making the task of removing the screw cap from the bottle even more difficult as the smaller the screw cap is the more difficult it may be to remove it. As follows, there is a need for the current beverage and water bottles in the industry to have screw cap diameters of at least two inches that can be more easily removed than the current screw caps on the market.

Over the years, a variety of U.S. patents have issued on bottle handles and bottle openers. U.S. Pat. No. 3,275,366 issued to W. E. Hidding Feb. 23, 1965, shows plastic carrier with a support having a first collar section and a second collar section, the two collar sections are connected to a neck of a bottle below a bead of the bottle. Each collar section has a leading lug on one end and a trailing lug on the other end. A first rotatable coupling member and a second rotatable coupling member associates with each pair of leading and trailing lugs. A handle is connected to the rotatable coupling members. The manner in which the Hidding embodiment is configured could make the removal of the handle for the bottle rather tedious.

U.S. Pat. No. 3,463,536 issued to A. V. Updegraff Jan. 10, 1967 shows a handle having a flat annulus with the inner edge of the annulus having a plurality of radially inwardly extending flexible fingers disposed in the plane of the annulus. The handle has a U-shaped bail having a pair of spaced parallel arms and a base forming a finger grip. The annulus of the handle stretches over a shoulder of a bottle, supporting the bottle below the bottle shoulder. The handle flexes when lifting a bottle. The removal of the Updegraff handle from the bottle could be difficult, and the Updegraff bottle handle appears awkwardly shaped, and might possibly cause injury to the human hand when gripping the handle engaged with a full bottle of liquid.

U.S. Pat. No. 4,768,403 issued to Gideon Baar-Noy Sep. 6, 1988 shows a combination bottle opener and bottle handle. The device has two parts connected together pivotably by means of a pin. Each of the two parts is provided with a semi-circular cutout. One of the parts has a hook-like member while the other part has a notch that enables both parts to be fastened together when used as a handle. This handle might not work with a large bottle as the neck of the bottle could give out from the weight of the bottle contents, causing the bottleneck to collapse.

U.S. Pat. No. 5,183,169 issued to Stephen D Grzych Feb. 2, 1993 shows a reusable bottle handle having an upwardly diverging bonnet shaped jacket with an arm extending upward from the jacket. The arm includes a bottle neck ring at a free end of the arm and a gripping portion between the bottle neck and the jacket. The thin plastic handle in this embodiment may be rather awkward to grasp with the human hand.

U.S. Pat. No. 5,577,647 issued to Diana Pitarelli and Michael J. Langieri, Jr shows a single bottle carrier with a strap attached to a bottle carrying device through two apertures extending horizontally through the bottle carrying device. The bottle carrying device has a squeeze spout located in the center area of the bottle carrying device above a bottle top that it receives. The bottle carrying device is designed to be used with water bottles that can be held in the hand.

U.S. Pat. No. 6,394,517 issued to James C. Borg May 28, 2002 shows a single bottle carrier. The Borg handle is similar to the Updegraff embodiment, however the Borg handle grasps a bottle beneath a flange near the top of the bottle. Additionally the Borg handle has scalloped inner edges dimensioned to fit the fingers of a user's hand. Nevertheless, the Borg handle is made of thin plastic and it could be rather painful on the human fingers using the Borg handle to carry the weight a 3 liter, or one gallon bottle that weighs 8 pounds. Also, once engaged with the bottle the Borg handle, as with the Updefraff handle, cannot be removed from the bottle, and is not reusable.

U.S. Publication 2015/0041427 A1 Pub. Feb. 12, 2015 of Khun, Nyan Taw, shows a combination bottle handle, opener, and hanger. It is designed to serve as a bottle handle, opener, and an apparatus that allows users to hang or secure their plastic bottles to other items such as a backpack or a bike bag. A bottle is inserted into an insertion hole on a bottle attachment portion and pressed into a smaller bottle lock hole in order to position a bottle neck flange groove of the bottle attachment portion. A first and second tapered edge traversing from the bottle insertion hole to the bottle locking hole are separated by a distance smaller that the bottle locking hole, providing additional support for the bottle within the bottle locking hole. A bottle-opening portion adjacent to the bottle attachment portion allows the user to open a capped glass bottle, and a handle portion provides an area for the user to easily hold, handle, and manipulate the bottle while in the locked position. This embodiment is limited to bottles with a volume of two liters or less.

SUMMARY OF THE DISCLOSURE

In accordance with one embodiment, a bottle carrier for use with a bottle is disclosed. The bottle has a screw cap. The bottle carrier has a diameter of at least two inches. An internally threaded socket has a solid ceiling and a perimeter. The internally threaded socket receives an externally threaded bottle top of the bottle. The bottle carrier replaces the screw cap. At least two apertures in the bottle carrier receive a handle. The apertures extend through the bottle carrier beyond the perimeter of the internally threaded socket. A handle engages the bottle carrier through at least two apertures thereof.

In accordance with one embodiment, a bottle carrier for use with a bottle is disclosed. The bottle has a screw cap. The bottle carrier has a diameter of at least two inches. An internally threaded socket has a solid ceiling and perimeter. The internally threaded socket receives an externally threaded bottle top of the bottle. The bottle carrier replaces the screw cap. At least two apertures extend through the bottle carrier beyond the perimeter of the internally threaded socket. A magnet engages the bottle carrier. The magnet can secure a container to the bottle carrier. A handle engages the bottle carrier through at least two apertures thereof.

In accordance with one embodiment, a bottle carrier for use with a bottle is disclosed. The bottle has a screw cap. The bottle carrier has a diameter of at least two inches. An internally threaded socket receives an externally threaded bottle top of the bottle. The bottle carrier replaces the screw cap. A magnet engages the bottle carrier. The magnet can secure a container to the bottle carrier. A handle engages the bottle carrier.

BRIEF DESCRIPTION OF THE DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

FIG. 5—is a top plan view of the exemplary bottle carrier, the exemplary magnet cavity, the exemplary magnet, and the exemplary magnet cavity plug in accordance with one aspect of the present application;

FIG. 6—is a top plan view of the exemplary bottle carrier in accordance with one aspect of the present application;

FIG. 7—is a bottom plan view of the exemplary bottle carrier of FIG. 5 in accordance with one aspect of the present application;

FIG. 12 is an elevational view of the exemplary bottle carrier engaged with the exemplary rope handle and the exemplary tube in accordance with one aspect of the present application;

FIG. 13 is an elevational view of an exemplary handle grip in accordance with one aspect of the present application; and FIG. 14 is an elevational view of the exemplary bottle carrier engaged with the exemplary rope handle, the exemplary tube, and the exemplary handle grip in accordance with one aspect of the present application.

DETAILED DESCRIPTION OF THE DISCLOSURE

Figure 1:
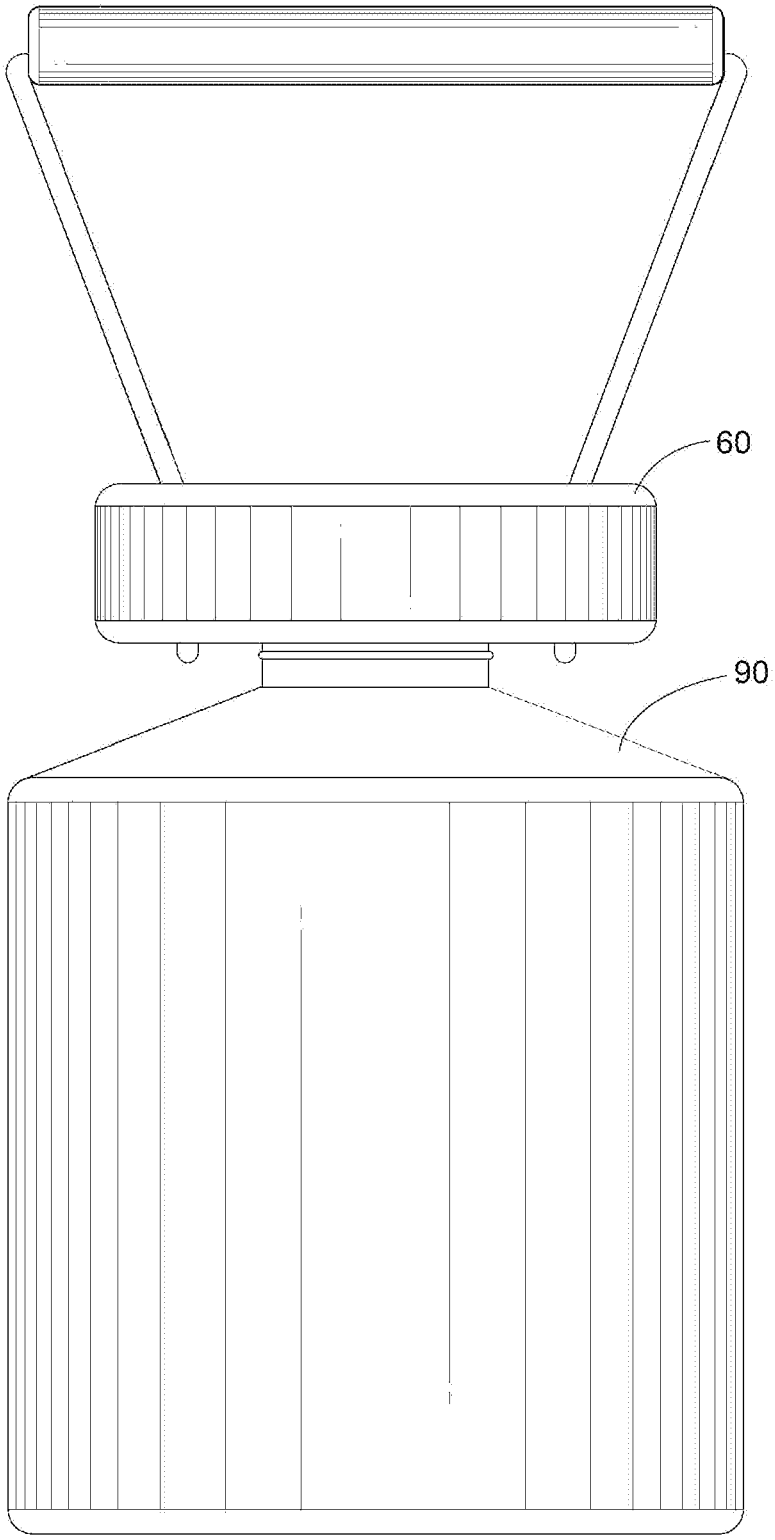
FIG. 1 is an elevational side view of an exemplary bottle carrier engaged with an exemplary handle and an exemplary tube, and an exemplary bottle in accordance with one aspect of the present application.

The description set forth below in connection with the appended drawings is intended as a description of presently preferred embodiments of the disclosure and is not intended to represent the forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that also are intended to be encompassed within the spirit and scope of this disclosure.

Accordingly, there are one or more aspects to the present bottle carrier that offers advantages over the current existing methods that are being used for capping and removal of screw caps from beverage and water bottles, and for transportation of beverage and water bottles. Embodiments of the disclosure provide a bottle carrier that may easily replace the screw cap removed from the bottle with a bottle carrier that may have a diameter of at least two inches that may be more easily unscrewed from the bottle, offer a handle for transport, offer an upgraded handle that may be less likely to cause pain and discomfort to the human hand verses the current bottle handles on the market, and have a magnet that may secure a container to the bottle carrier.

In accordance with one embodiment the bottle carrier may make the removal of a screw cap from a beverage or water bottle a very easy task, and may prevent pain and/or injury to the human hand in the process of removing the screw cap from the bottle. The screw cap may be removed from the bottle. The bottle carrier may have an internally threaded socket. The bottle carrier may receive a threaded top of a bottle by placing the internally threaded socket side of the bottle carrier directly above the threaded top of the bottle, lowering it down, and rotating it upon the threaded top of the bottle so that the internally threaded socket of the bottle carrier receives the threaded top of the bottle. The bottle carrier may then be easily rotated and removed from the bottle as the bottle carrier may have a diameter of at least two inches, which may be easier to remove from the bottle than the smaller diameter screw cap.

In accordance with one embodiment the bottle carrier may make the transportation of a beverage or water bottle a very easy task. A screw cap may be removed from a bottle. The bottle carrier may then be secured to the bottle by rotating it onto a threaded top of the bottle. The bottle carrier may provide a rope handle that is secured to the bottle carrier through at least one aperture. The rope handle may be used in the transportation of the bottle carrier that may be secured to the bottle. Additionally, the bottle carrier may provide a tube that may engage with the rope handle, the tube may provide additional support for the human hand over the rope handle when the bottle carrier may be secured to a bottle and carried.

In accordance with one embodiment, the bottle carrier may provide a handle grip that may slide over and receive the tube. The handle grip may provide more comfort and a better grip for the human hand when the bottle is being transported with the bottle carrier. The handle grip may also engage the rope handle without the usage of tube.

In accordance with one embodiment, the bottle carrier may have a magnet. The magnet may secure a container to the bottle carrier. The container could be used to drink from or as a holder for a group nested cups disposable cups. Having a container secured to the bottle carrier may be a big positive for the user of the bottle carrier. The secured container may allow for the beverage or water in the bottle to be poured into the container or into the disposable cups, thus avoiding drinking directly from the bottle and contaminating the contents of the bottle, and having the option of sharing the contents of the beverage or water bottle with others. The magnet of the bottle carrier may also secure a metallic cup or a cup having a magnet to the bottle carrier. The above advantages of one or more aspects of the bottle carrier will become apparent upon reflection of the disclosure set forth below.

Referring to FIG. 1 an elevational view of a bottle carrier 60 may be seen. The bottle carrier 60 may be shown engaged upon a bottle 90.

Figure 2:
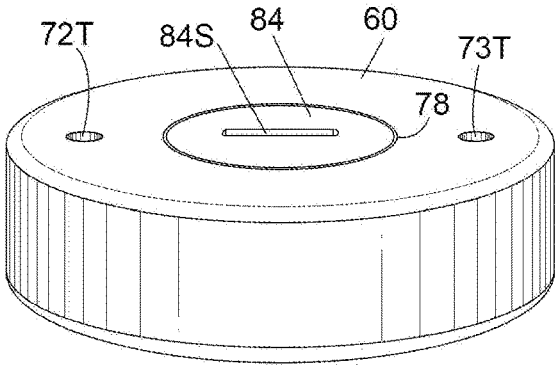
FIG. 2 is a perspective top side view of the exemplary bottle carrier having an exemplary magnet cavity and an exemplary magnet cavity plug in accordance with one aspect of the present application.

Referring to FIG. 2, a topside perspective view of the bottle carrier 60 may be seen. Although the bottle carrier 60 may be illustrated as being round in shape, the bottle carrier 60 may be offered in a number of other geometrical shapes and sizes. The bottle carrier 60 may have a threaded socket 78 for housing a magnet (not shown). The threaded socket 78 may have a threaded socket plug 84. The threaded socket plug 84 may have a slot 84S wherein a screwdriver (not shown) may be inserted to remove the threaded socket plug 84 from the threaded socket 78. In FIG. 2, a top aperture 72T and a top aperture 73T may be seen extending upwards at the top of the bottle carrier 60. The top apertures 72T and 73T may be used to engage a handle (shown later) to the bottle carrier 60 that may extend upwards through the top apertures 72T and 73T. The handle (shown later) may attach to the bottle carrier 60 through the two top apertures 72T and 73T. Although two top apertures 72T and 73T are shown, two top apertures 72T and 73T may not be needed to engage a handle (shown later) to the bottle carrier 60, however at least one of the two top apertures 72T and 73T may be needed to engage the bottle carrier 60 to a handle (shown later). The top apertures 72T and 73T may merge with a bottom socket 72B and a bottom socket 73B of FIG. 4.

Figure 3:
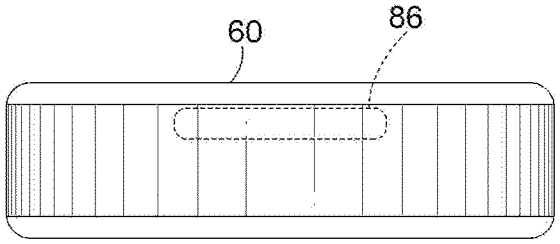
FIG. 3 is an elevational view of the exemplary bottle carrier of FIG. 2 in accordance with one aspect of the present application.

Referring to FIG. 3 an elevational view of the bottle carrier 60 may be seen. The bottle carrier 60 may be formed in plastic using plastic injection molding, however other types of compounds such as metal could be used, or a combination of both plastic and metal could be used to form the bottle carrier 60. The dashed lines of FIG. 3 may represent the position of a magnet 86 within the bottle carrier 60.

Figure 4:
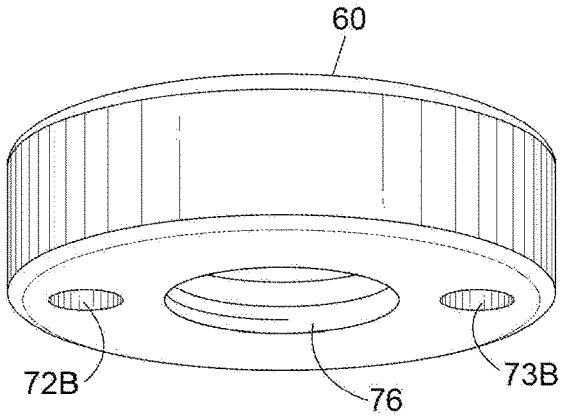
FIG. 4 is a perspective bottom side view of the exemplary bottle carrier of FIG. 2 in accordance with one aspect of the present application.

Referring to FIG. 4, a bottom side perspective view may be seen of the bottle carrier 60. The bottom sockets 72B and 73B may be larger in diameter than the top apertures 72T and 73T of FIG. 2, the bottom sockets 72B and 73B may be formed to receive a handle stop (shown later). An internally threaded socket 76 may be seen in the present embodiment.

Referring to FIG. 5 a top plan view of the bottle carrier 60 may be seen. The socket slot 84S of the socket plug 84 of the threaded socket 78 may be viewed. Additionally, the magnet 86 that may be represented by dashed lines may be seen housed within the threaded socket 78. Also, the two top apertures 72T and 73T may be viewed in the current embodiment.

Referring to FIG. 6, a bottom plan view of the bottom side of a screw cap 80 may be illustrated.

Referring to FIG. 7 a bottom plan view of the bottle carrier 60 may be seen. The internal threads (not shown) of the internally threaded socket 76 having a solid ceiling 79 of the bottle carrier 60 may be formed to match the internal threads (not shown) of the screw cap 80 of FIG. 6. The bottom sockets 72B and 73B may be seen in the present embodiment.

Figure 8:
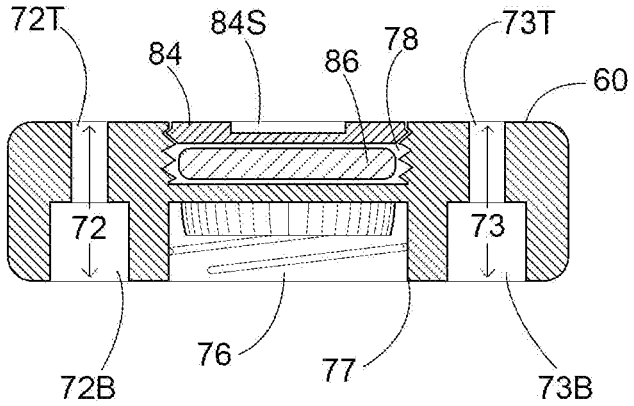
FIG. 8 is a sectional view of FIG. 5 taken at the sectioning plane in the direction indicated by section lines 8-8 in accordance with one aspect of the present application.

Referring to FIG. 8, a sectional view taken at the sectioning plane in the direction indicated by section lines 8-8 of FIG. 5 may be seen. The FIG. 8 sectional view may show an aperture 72 and an aperture 73 extending through the bottle carrier 60 beyond a perimeter 77 of the internally threaded socket 76 of the bottle carrier 60. The top apertures 72T and 73T may merge with the bottom sockets 72B and 73B respectively to form the apertures 72 and 73. The bottom sockets 72B and 73B may be larger in diameter the top apertures 72T and 73T. The internally threaded socket 76 of the bottle carrier 60 may be formed to receive an externally threaded bottle top of a bottle (not shown yet). The magnet 86 may be viewed as housed within the internally threaded socket 78. Additionally, the slot 84S that may be used to remove the socket plug 84 from the internally threaded socket 78 may be illustrated.

Figure 9:
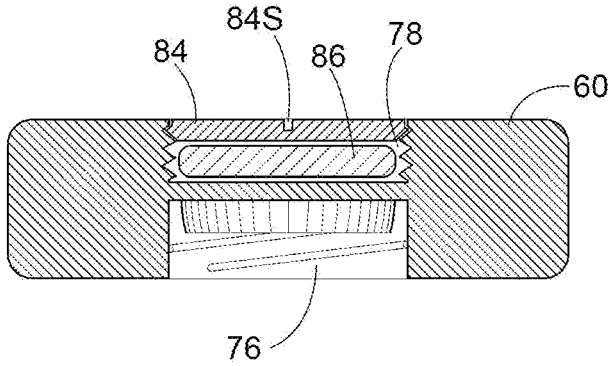
FIG. 9 is a sectional view of FIG. 5 taken at the sectioning plane in the direction indicated by section lines 9-9 in accordance with one aspect of the present application.

Referring to FIG. 9 another sectional view of bottle carrier 60 taken at the sectioning plane in the direction indicated by section lines 9-9 of FIG. 5 may be seen. The internally threaded socket 76 of the bottle carrier 60, the socket slot 84S, of the socket plug 84, and the magnet 86 that may be housed inside the internally threaded socket 78 may be seen.

Figure 10:
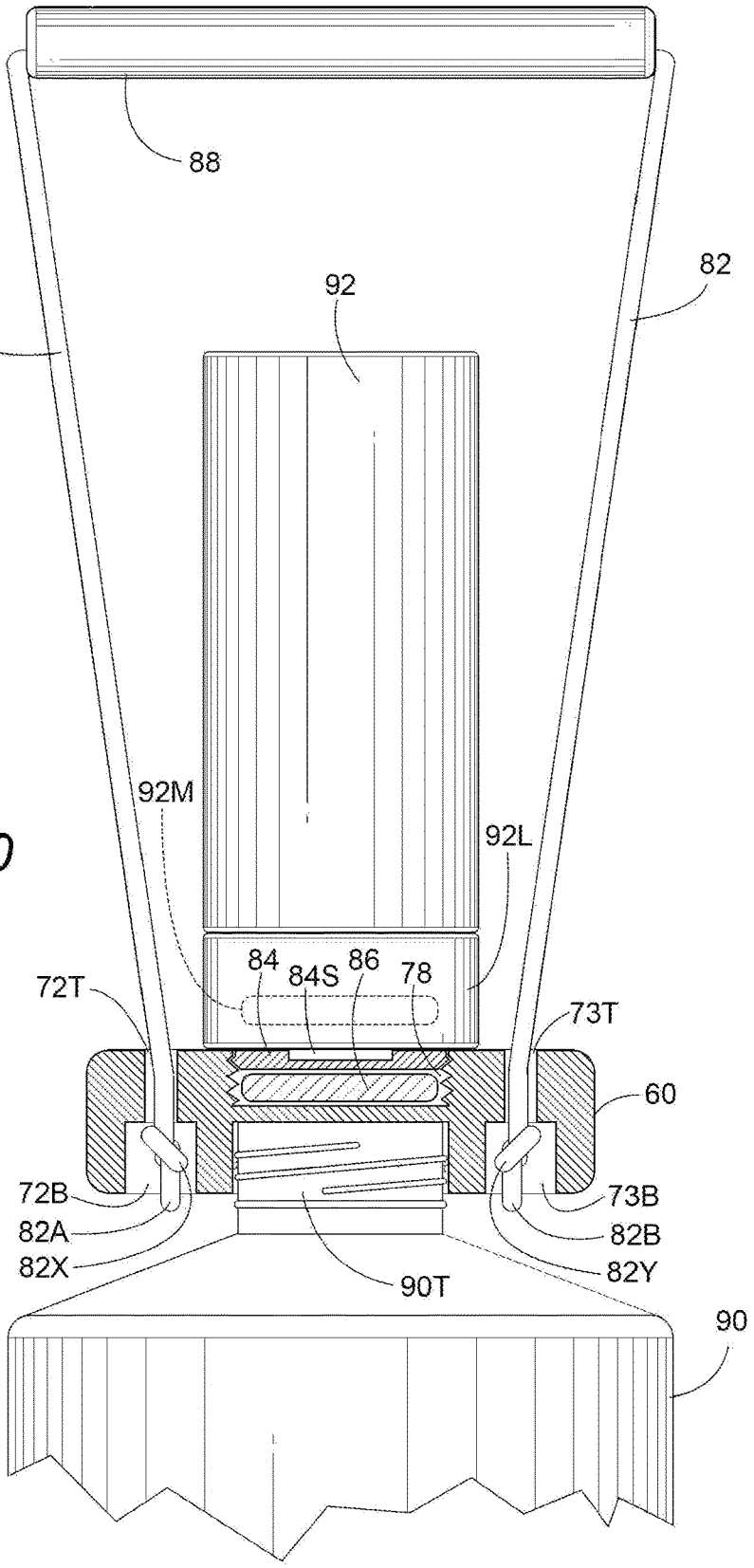
FIG. 10 is an elevational view of the exemplary bottle carrier of FIG. 8 engaged with the exemplary bottle, the exemplary rope handle, and the exemplary tube, and an exemplary container in accordance with one aspect of the present application.

Referring to FIG. 10, an elevational view of the bottle carrier 60 of FIG. 8 engaged with a rope handle 82, a tube 88, the bottle 90, and a container 92 may be seen. The bottle carrier 60 may be seen engaged upon an externally threaded bottle top 90T of a broken view of the bottle 90. The rope handle 82 may be used to lift the bottle carrier 60. The rope handle 82 may require at least two apertures. The rope handle 82 may be engaged with the bottle carrier 60 as the bottle carrier 60 may embody at least two apertures, apertures 72 and 73 of FIG. 8. The rope handle 82 may been seen engaging the bottle carrier 60 extending upwards through the top apertures 72T and 73T, and a handle stop 82X and a handle stop 82Y at a first rope end 82A and a second rope end 82B may be received by the bottom sockets 72B and 73B respectively. The handle stops 82X and 82Y may be larger in diameter than the top apertures 72T and 73T, and may stop the rope handle 82 from moving through the top apertures 72T and 73T when the rope handle may be in use. The rope handle 82 may be used to carry the bottle 90 when the bottle 90 may be engaged with the bottle carrier 60. The rope handle 82 may be viewed engaging a tube 88. The tube 88 may be provided to add additional support to the human hand (not shown) when the rope handle 82 may be engaged with the bottle carrier 60 and the bottle carrier 60 may be engaged with the bottle 90. Although a rope handle 82 is shown being used with the bottle carrier 60, other types of handles could be used as well with the bottle carrier 60, such as a cable handle, a plastic handle or a chain link handle. Additionally, the container 92 having a threaded top (threaded top not shown), and a container lid 92L may be seen in an inverted position resting upon the bottle carrier 60. The container lid 92L may have internal threads (internal threads not shown) that may engage with the threaded top (threaded top not shown) of the container 92 to join the container 92 and the container lid 92L together. The container lid 92L may embody a magnet 92M as represented by the dashed lines. The magnet 92M of the container lid 92L may be magnetically attracted to the magnet 86 of the bottle carrier 60, thus magnetically securing the container lid 92L and the container 92, to the bottle carrier 60, which may prevent the container 92 from falling off of the bottle carrier 60 when the bottle carrier 60 may be used to transport the bottle 90. Also, the container lid 92L and/or the container 92 could be formed of/or include a metal compound, which may be used in place of the magnet 92M, as the metal compound of the container lid would attract to the magnet 86, and may secure the container lid 92L and the container 92 to the bottle carrier 60. Additionally, a base of a drinking up or tumbler (not shown) could embody a magnet 92M thus magnetically securing the drinking cup or tumbler (not shown) to the magnet 86 of the bottle carrier 60. The magnet 86 may enable the bottle carrier 60 to be magnetically secured to a metallic side of a refrigerator (not shown). The socket slot 84S of the socket plug 84 of the threaded socket 78 may be viewed in the present embodiment.

Figure 11:
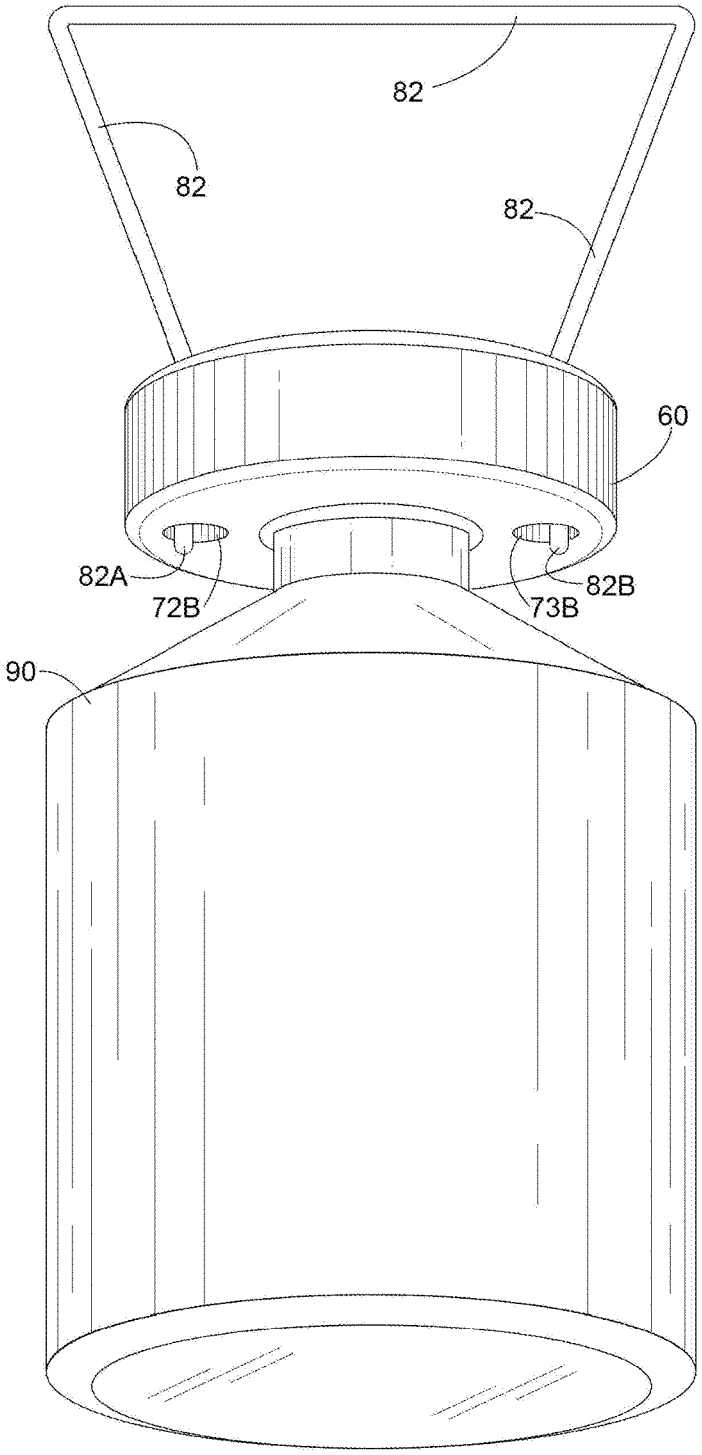
FIG. 11 is a perspective view of a bottom side of the exemplary bottle carrier engaged with the exemplary rope handle and the exemplary bottle in accordance with one aspect of the present application.

Referring to FIG. 11 a perspective view of the bottle carrier 60 may be seen engaged to the rope handle 82 and upon the bottle 90. The first rope end 82A may be seen extending through the bottom socket 72B and the second rope end 82B may be seen extending through the bottom socket 73B of the bottle carrier 60. It may be noted that the rope handle 82 may not be engaged to a tube 88 of FIG. 10, unlike the embodiment of FIG. 10.

Referring to FIG. 12, an elevational view of the bottle carrier 60 may be seen engaged with the rope handle 82. The rope handle 82 may be engaged with the tube 88. The first and second rope ends 82A and 82B may be seen in the present embodiment.

Referring to FIG. 13, an elevational view of a handle grip 94 may be seen. The handle grip 94 could be made of a material such as foam or rubber. The handle grip 94 may provide more comfort and a better grip for the human hand (not shown) when a bottle (not shown) is being transported with the bottle carrier 60.

Referring to FIG. 14, an elevational view of the bottle carrier 60 may be seen engaged with the rope handle 82. The rope handle 82 may be viewed engaged with the tube 88. The dashed lines represent the tube 88 as seen inside of the handle grip 94. The handle grip 94 may be seen receiving and engaged with the tube 88, and the tube 88 may be viewed inserted into the handle grip 94. The first and second rope ends 82A and 82B may be seen in the present embodiment.

Figure 15:
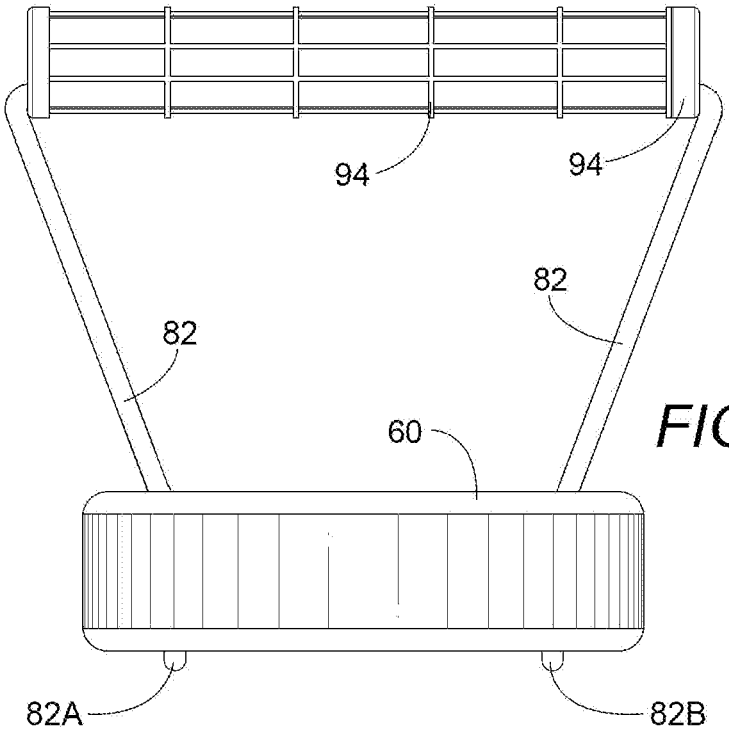
FIG. 15 is an elevational view of the exemplary bottle carrier engaged with the exemplary rope handle and the exemplary handle grip in accordance with one aspect of the present application.
Figure 16:
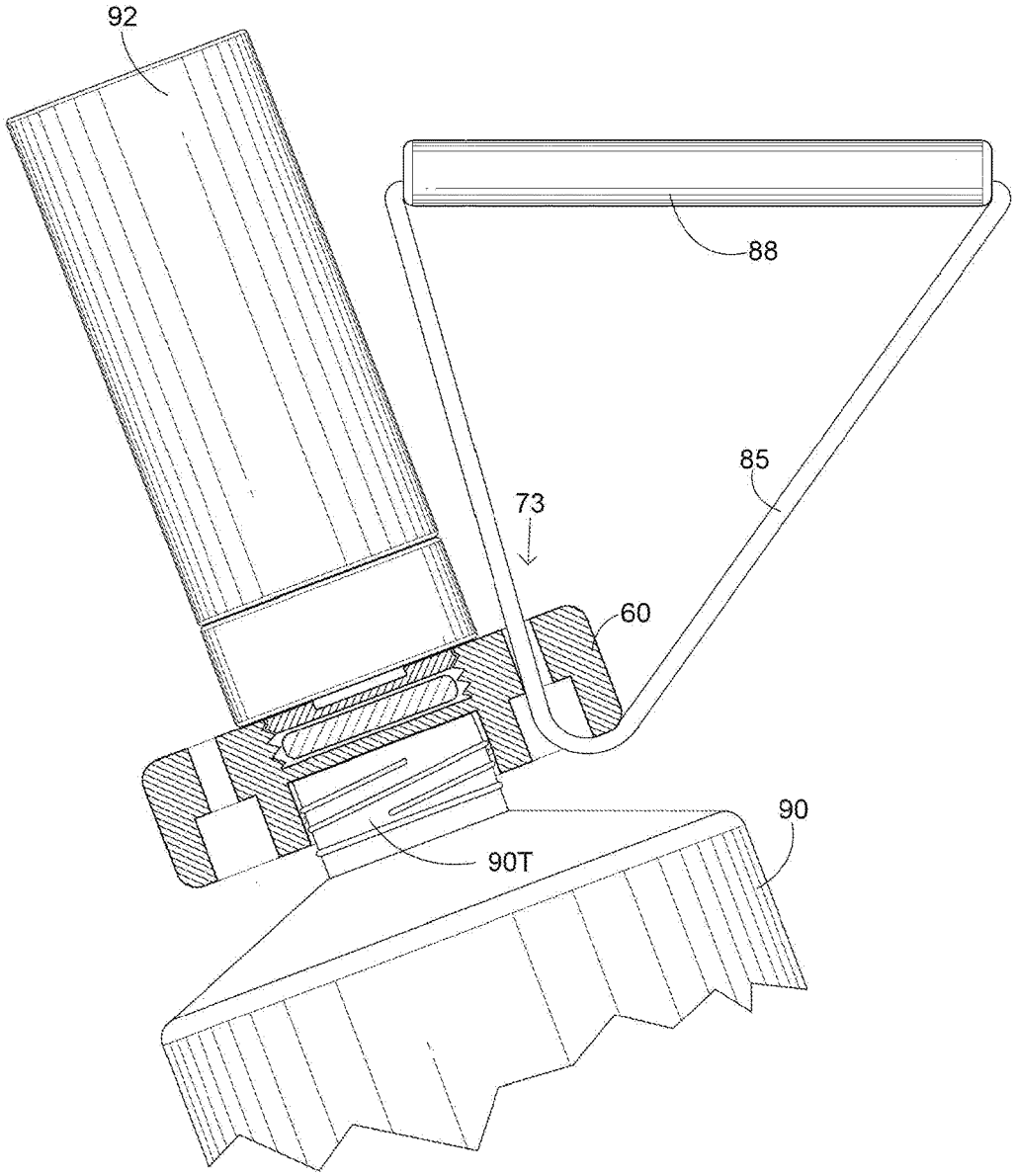
FIG. 16 is an elevational view of the exemplary bottle carrier of FIG. 8 engaged with the exemplary bottle, an exemplary rope handle, the exemplary tube, and the container in accordance with one aspect of the present application.

Referring to FIG. 15, an elevational view of the bottle carrier 60 may be seen engaged with the rope handle 82. The rope handle 82 may be viewed engaged the handle grip 94. The handle grip 94 may be seen receiving and engaged with the rope handle 82. The first and second rope ends 82A and 82B may be seen in the present embodiment Referring to FIG. 16, an elevational view of the bottle carrier 60 of FIG. 8 engaged with a rope handle 85, the tube 88, a broken view of the bottle 90, and the container 92 may be seen. The bottle carrier 60 may be seen engaged upon the externally threaded bottle top 90T of a broken view of the bottle 90. A rope handle 85 having a continuous loop may require only one aperture 73 to engage with the bottle carrier 60, and may be seen engaging the bottle carrier 60 through at least one aperture 73. A rope knot, and the two ends of the rope handle 85 (not shown) may be positioned within the tube 88. Additionally, the handle grip 94 of FIGS. 13-14 may be used with the rope handle 85 and the tube 88. The handle grip 94 may also be used with the rope handle 85 without the use of the tube 88 as seen in FIG. 15 with the rope handle 82.

Figure 17:
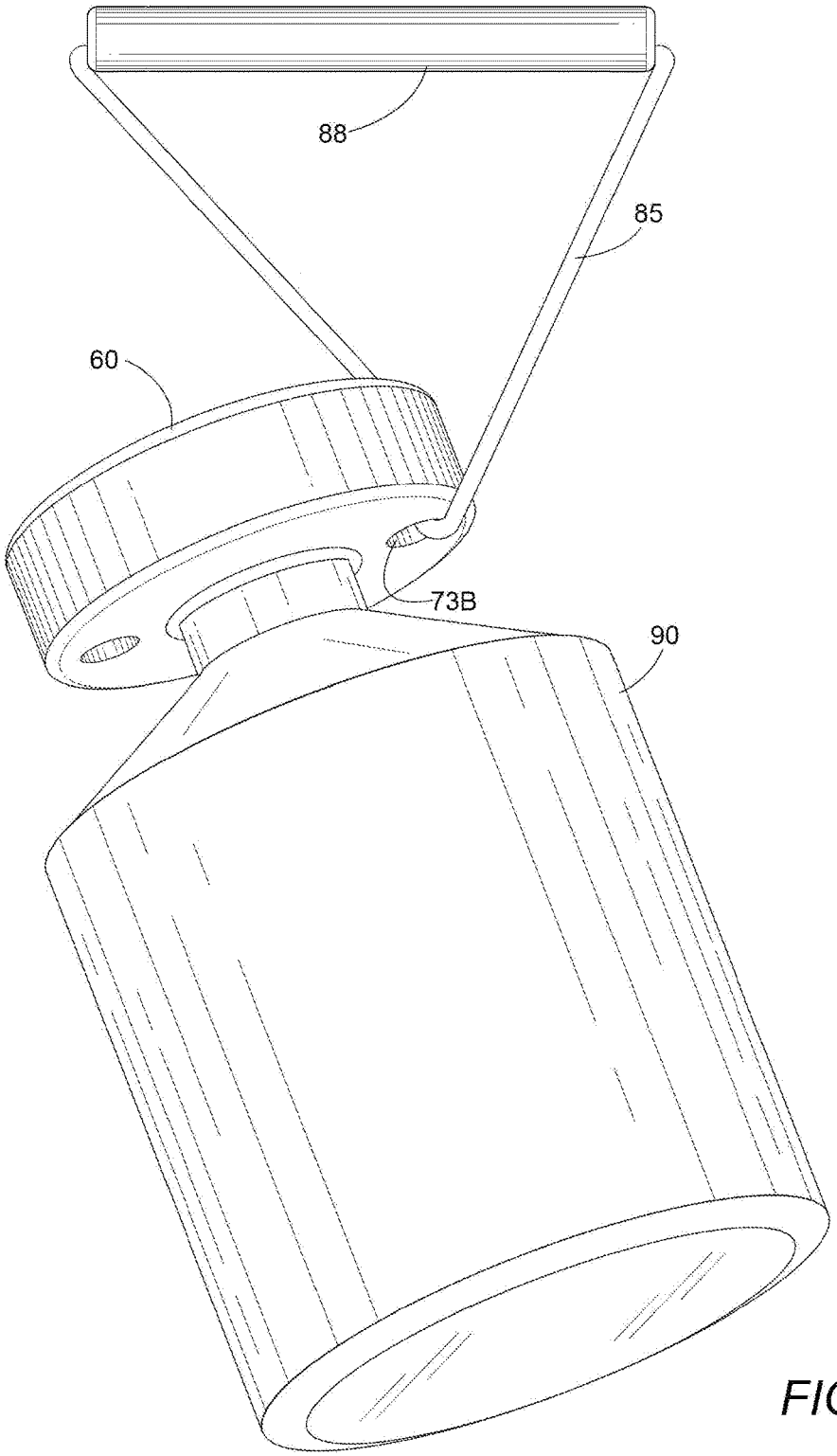
FIG. 17 is a perspective view of the exemplary bottle carrier engaged with the exemplary rope handle of FIG. 16, the exemplary tube, and the exemplary bottle in accordance with one aspect of the present application.

Referring to FIG. 17 a perspective view of the bottle carrier 60 may be seen engaged with the bottle 90. The rope handle 85 may be seen engaged to the bottle carrier through the aperture 73 as viewed in FIG. 16. The rope handle 85 may require at least one aperture to engage the bottle carrier 60. The tube 88 may be seen, and the rope handle 85 may be viewed extending through the bottom socket 73B of aperture 73 as may be viewed in FIG. 16.

Figure 18:
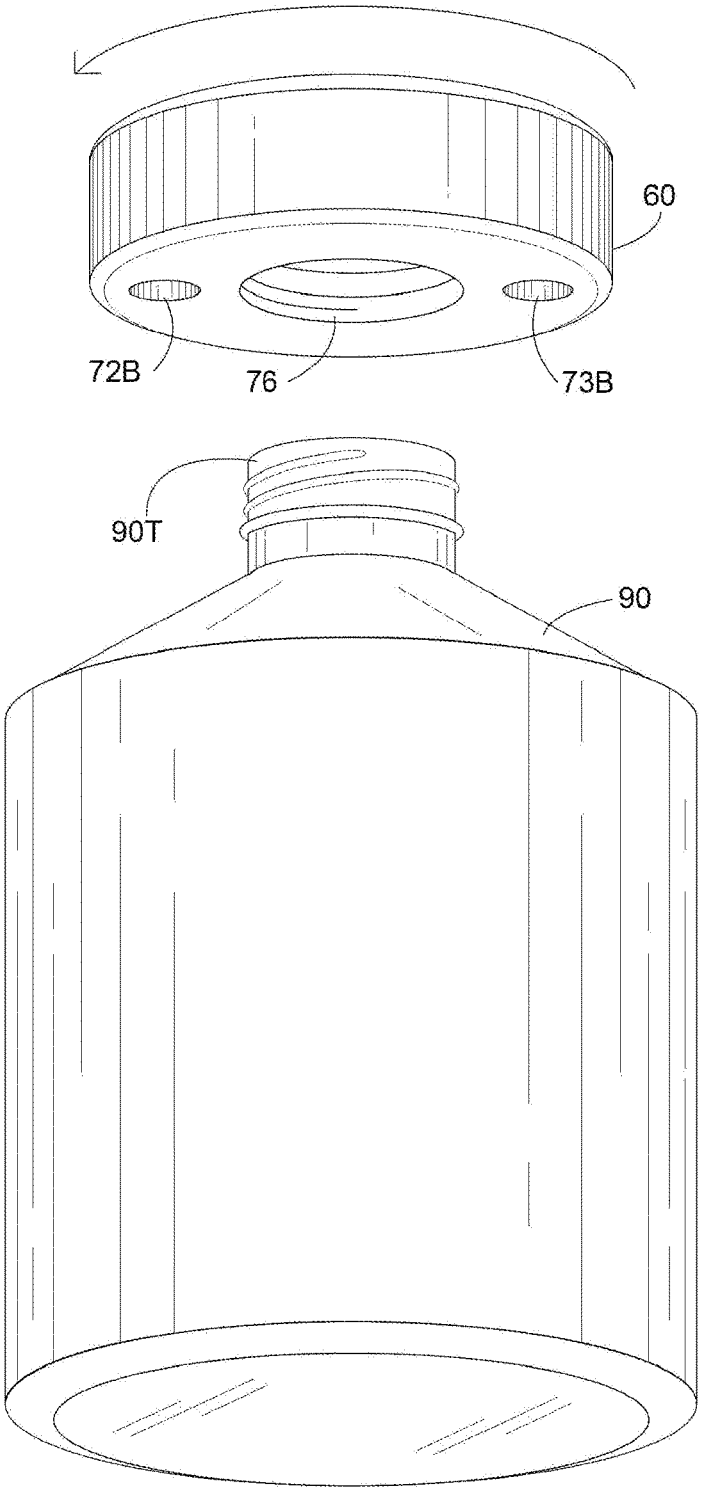
FIG. 18 is a perspective view of a bottom side of the exemplary bottle carrier with the exemplary internally threaded socket positioned directly above the exemplary threaded bottle top of the exemplary bottle in accordance with one aspect of the present application.
Figure 19:
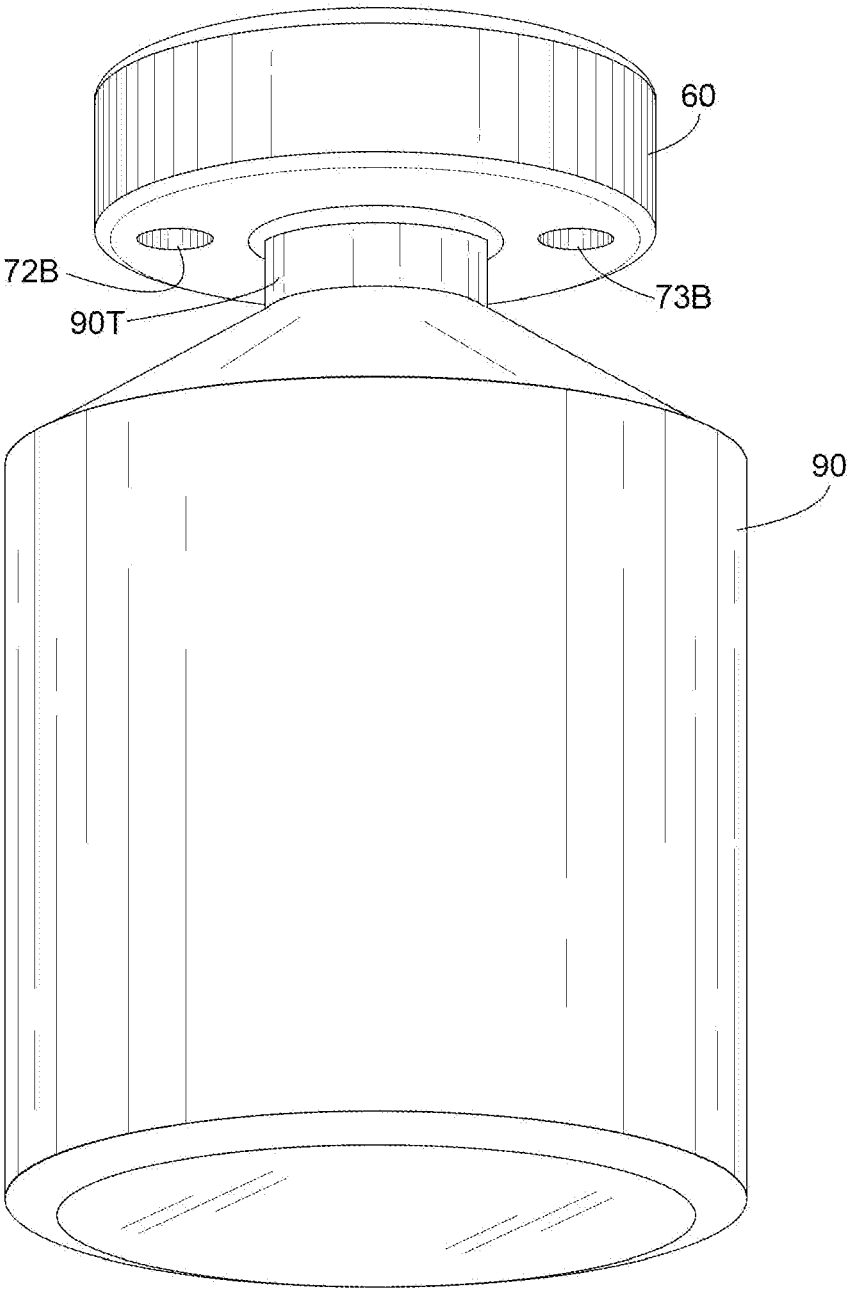
FIG. 19 is a perspective view of a bottom side of the exemplary bottle carrier engaged with the exemplary bottle in accordance with one aspect of the present application.

Referring to FIG. 18, the internally threaded socket 76 of the bottle carrier 60 may be seen located directly above the externally threaded bottle top 90T of the bottle 90. The internally threaded socket 76 of the bottle carrier 60 may then be placed upon the externally threaded bottle top 90T of the bottle 90 and the bottle carrier 60 may be rotated in the direction as shown by the arrow in FIG. 18. Upon completion of the rotation of bottle carrier 60 upon the externally threaded bottle top 90T of bottle 90, the bottle carrier 60 may be engaged upon the bottle 90 as seen in FIG. 19, and the internally threaded socket 76 of the bottle carrier 60 may have received the externally threaded bottle top 90T of the bottle 90. The bottom sockets 72B and 73B of the bottle carrier 60 may be seen in the current embodiment.

Referring to FIG. 19, the bottle carrier 60 may be seen engaged upon the externally threaded bottle top 90T of the bottle 90. The bottom sockets 72B and 73B may be seen in the present embodiment.

Figure 20:
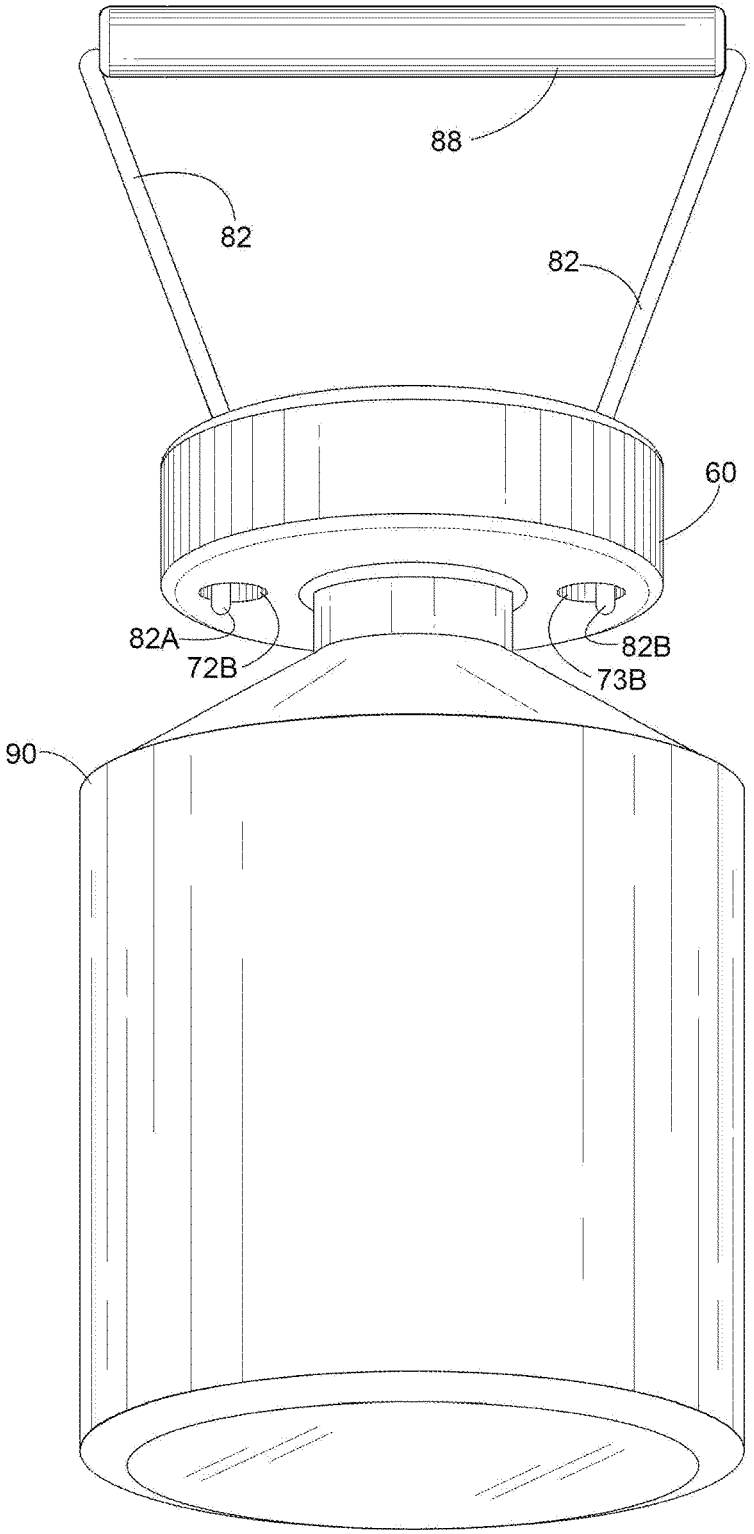
FIG. 20 is a perspective view of the exemplary bottle carrier engaged with the exemplary rope handle, the exemplary tube, and the exemplary bottle in accordance with one aspect of the present application.

Referring to FIG. 20 a perspective view of the bottle carrier 60 may be seen engaged with the bottle 90 and the rope handle 82. The tube 88 may be engaged with the rope handle 82. The first and second rope ends 82A and 82B may be seen extending through the bottom sockets 72B and 73B of the bottle carrier 60.

Referring to FIGS. 10, 18-19 and FIGS. 12-15 the operation of bottle carrier 60 may now be described. To begin with, if the rope handle 82 is not already attached to the bottle carrier 60, the rope will need to be attached. The rope knot 82X can be tied at the first rope end 82A (FIG. 10) and then the second rope end 82B can be inserted into the bottom socket 72B and exit the top aperture 72T. Next, if a tube 88 might be included with the rope handle 82, the rope second end 82B may be inserted into and pushed through the tube 88. If a handle grip 94 (FIGS. 13-15) is included with the rope handle 82 and the tube 88, the tube 88 can be inserted into the handle grip 94 prior to pushing the rope second end 82B through the tube 88. Additionally, if there is no tube 88, but a handle grip 94 is included, the rope second end 82B can be inserted into and pushed through the handle grip 94. Next, the rope second end 82B can then be inserted through the top aperture 73T and out the bottom socket 73B. The handle stop 82Y may then be tied at the rope second end 82B to secure the rope handle 82 to the bottle carrier 60 per FIG. 10. To install the bottle carrier 60 on the bottle 90, the internally threaded socket 76 of the bottle carrier 60 may then be placed upon the externally threaded bottle top 90T of the bottle 90 and the bottle carrier 60 may be rotated in the direction as shown by the arrow in FIG. 18. Upon completion of the rotation of bottle carrier 60 upon the externally threaded bottle top 90T of bottle 90, the bottle carrier 60 may be engaged upon the bottle 90 as seen in FIGS. 19 and 20, and the internally threaded socket 76 of the bottle carrier 60 may have received the externally threaded bottle top 90T of the bottle 90. The bottle 90 may now be ready for transport using the bottle carrier 60.

Figure 21:
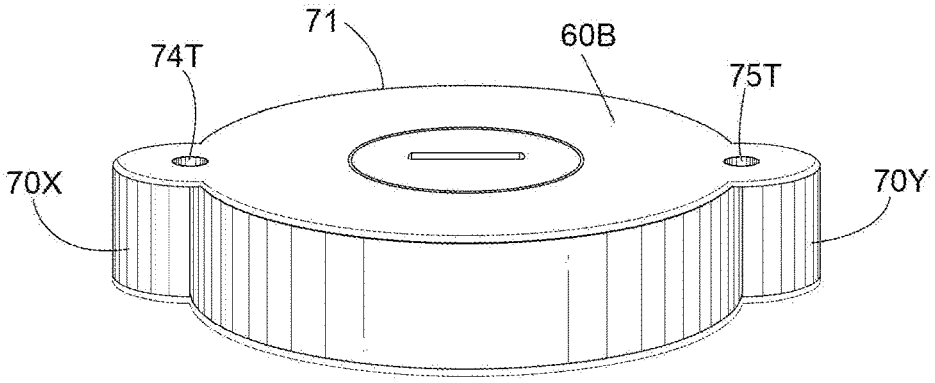
FIG. 21 is a perspective top side view of an exemplary alternative bottle carrier having the exemplary magnet cavity, the exemplary magnet, and the exemplary magnet cavity plug in accordance with one aspect of the present application.

Referring to FIG. 21, a top perspective view of an alternate bottle carrier 60B may be seen. A top aperture 74T and a top aperture 75T of the alternative bottle carrier 61B may be seen extending upwards through an ear 70X and an ear 70Y of the bottle carrier 60B, and may be spaced further apart than top apertures 72T and 73T of the bottle carrier 60 of FIG. 2. The ears 70X and 70Y may extend outwards beyond a main body 71 of the bottle carrier 60B. A rope handle (not shown) may extend upwards through the top apertures 74T and 75T beyond the perimeter 77 of the internally threaded socket 76 of FIG. 22.

Figure 22:
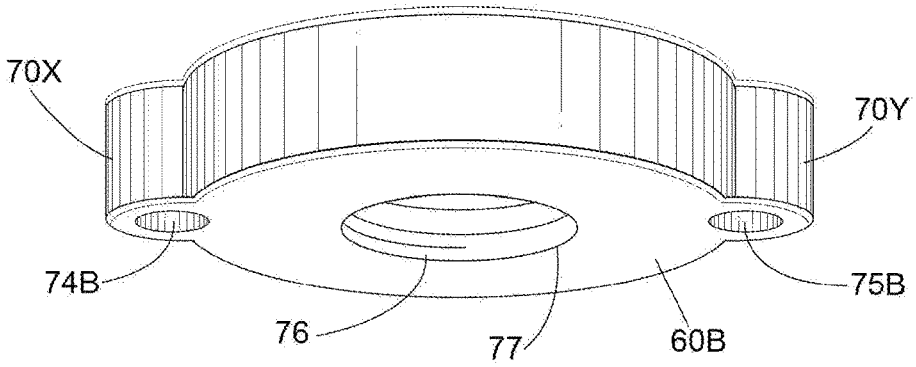
FIG. 22 is a perspective bottom side view of the exemplary alternative bottle carrier of FIG. 21 in accordance with one aspect of the present application.

Referring to FIG. 22, a bottom perspective view of the alternate bottle carrier 60B may be seen. The bottom sockets 74B and 75B may be formed within the ears 70X and 70Y, and may be in alignment with the top apertures 74T and 75T of FIG. 21, and the bottom sockets 74B and 75B may be spaced further apart than the bottom sockets 72B and 73B of FIG. 4. A rope handle (not shown) may extend upwards from the bottom sockets 74B and 75B and engage the alternative bottle carrier 60B beyond the perimeter 77 of the internally threaded socket 76.

The bottle carriers 60 and 60B may replace a screw cap of a bottle. The bottle carriers 60 and 60B may be larger in diameter than the screw cap they replace which may facilitate removal of the bottle carrier from the bottle. The rope handle 82 may be very useful for transporting beverage and water bottles that have no handle. Also, for bottles that do have a handle, the rope handle 82 may be a needed upgrade over the current bottle handles, as the rope handle 82 may provide for a more comfortable grip than the handles of the current beverage and water bottles sold in the markets. A tube may be engaged with the rope handle for an upgraded, firmer and more complete grip than that of the rope as a handle. And finally a handle grip 94 may receive and engage the tube, or may be used without the tube, to add upgraded level of comfort over having just the tube as a grip on bottle carriers 60 and 60B.

The bottle carriers 60 and 60B may embody a magnet 86 that may secure a container to the top the of the bottle carrier. Having a container secured to the bottle carrier may be a big positive for the user of the bottle carrier. The secured container may allow for the beverage or water in the bottle to be poured into the container and consumed from the container and not the bottle, which may allow for the water of beverage to be shared with others without risking contamination. A base of drinking cup or tumbler may embody a magnet within, thus magnetically securing the drinking cup to the bottle carrier. Additionally, the magnet 86 may enable the bottle carriers 60 and 60B to be secured to a metallic side of a refrigerator.

Lastly the bottle carriers 60 and 60B may be formed in a variety of geometrical shapes and sizes, and colors. The handle 82 of bottle carriers 60 and 60B could be formed from plastic, rope, cable, or a chain could be used as the handle. The tube could be made of plastic using injection molding, carbon, or of a metal such as stainless steel. The handle grip 94 could be composed of a foam or rubber material.

While embodiments of the disclosure have been described in terms of various specific embodiments, those skilled in the art will recognize that the embodiments of the disclosure may be practiced with modifications within the spirit and scope of the claims. For example, the bottle carrier could be formed in numerous shapes and sizes. Additionally, although at least one aperture may be needed in the bottle carrier for the engagement of a handle, the bottle carrier could have numerous apertures extending through it. Furthermore, the bottle carrier could be configured differently so that a handle could attach to the bottle carrier using methods other than that of having at least one aperture extending through it. Moreover, the magnet of the bottle carrier could be engaged to the bottle carrier by means other than having an internally threaded socket and a socket plug. Accordingly, the scope should be determined not by the specific embodiments illustrated, but by the appended claims and their legal equivalents.

I claim:

1. A bottle carrier for use with a bottle, the bottle having a screw cap, the bottle carrier having a diameter of at least two inches, the bottle carrier comprising:

an internally threaded socket having a solid ceiling and a perimeter, the internally threaded socket receiving an externally threaded bottle top of the bottle, the bottle carrier replacing the screw cap; and at least two apertures extending through the bottle carrier beyond the perimeter of the internally threaded socket;

a magnet engaging the bottle carrier for securing a container thereto; and a handle engaging the bottle carrier through at least two apertures thereof.

2. The bottle carrier of claim 1 comprising at least two sockets formed in a bottom side of the bottle carrier;

whereby the sockets may receive a handle stop.

3. The bottle carrier of claim 1 wherein the handle comprises at least two handle stops received by at least two sockets formed in a bottom side of the bottle carrier.

4. The bottle carrier of claim 1 wherein the handle is a rope handle.

5. The bottle carrier of claim 1 comprising:

a rope handle; and a tube engaging the rope handle.

6. The bottle carrier of claim 1 comprising:

a rope handle;

a tube engaging the rope handle; and a handle grip engaging the tube.

7. The bottle carrier of claim 1 comprising:

a rope handle; and a handle grip engaging the rope handle.

8. A bottle carrier for use with a bottle, the bottle having a screw cap, the bottle carrier having a diameter of at least two inches, the bottle carrier comprising:

an internally threaded socket having a solid ceiling and a perimeter, the internally threaded socket receiving an externally threaded bottle top of the bottle, the bottle carrier replacing the screw cap;

at least two apertures extending through the top of the bottle carrier beyond the perimeter of the internally threaded socket;

a handle engaging the bottle carrier through at least two apertures thereof; and a tubular handgrip engaging the handle, the tubular handgrip positioned directly above the internally threaded socket when the bottle carrier is in use.

9. The bottle carrier of claim 8 wherein the handle is a rope handle.

10. A bottle carrier for use with a bottle, the bottle having a screw cap, the bottle carrier having a diameter of at least two inches, the bottle carrier comprising:

an internally threaded socket having a solid ceiling and a perimeter, the internally threaded socket receiving an externally threaded bottle top of the bottle, the bottle carrier replacing the screw cap;

at least two apertures extending through the top side of the bottle carrier beyond the perimeter of the internally threaded socket;

a handle engaging the bottle carrier through at least two apertures thereof;

at least two handle stops surrounded by at least two sockets formed in a bottom side of the bottle carrier, the sockets having a diameter larger than a diameter of the apertures extending through the top side bottle carrier; and a tubular handgrip engaging the handle, the tubular handgrip positioned directly above the internally threaded socket when the bottle carrier is in use.

11. The bottle carrier of claim 8 wherein the handle is a rope handle.

* * * * *